United States Patent [19]

Saito et al.

[11] 4,442,181

[45] Apr. 10, 1984

[54] STEEL STRIP HAVING DIFFERENTIATED MULTILAYER COATINGS AND BEING USEFUL FOR MANUFACTURING OF CANS

[75] Inventors: Takao Saito; Kazuya Ezure, both of Himeji, Japan

[73] Assignee: Nippon Steel Corporation, Tokyo, Japan

[21] Appl. No.: 370,349

[22] Filed: Apr. 21, 1982

[30] Foreign Application Priority Data

Apr. 23, 1981 [JP] Japan ..... 56-61767
Jul. 17, 1981 [JP] Japan ..... 56-111639

[51] Int. Cl.[3] ..... B21D 51/26; B32B 15/04; B32B 15/18; C25D 5/12

[52] U.S. Cl. ..... 428/623; 478/679; 478/629; 478/648; 478/681

[58] Field of Search ..... 428/623, 679, 629, 648, 428/681; 29/195

[56] References Cited

U.S. PATENT DOCUMENTS

| | | | |
|---|---|---|---|
| 3,799,750 | 3/1974 | Bird | 29/195 T |
| 3,860,398 | 1/1975 | Tsuoumaru et al. | 428/629 |
| 3,978,803 | 9/1976 | Asano et al. | 428/626 |
| 4,035,248 | 7/1977 | Asano et al. | 428/667 |
| 4,082,621 | 4/1978 | Spiliotis et al. | 428/648 |

FOREIGN PATENT DOCUMENTS

| | | | |
|---|---|---|---|
| 2115052 | 9/1972 | Fed. Rep. of Germany . | |
| 36-10064 | 7/1961 | Japan . | |
| 36-15252 | 9/1961 | Japan . | |
| 55-158295 | 12/1980 | Japan | 428/629 |
| 1529146 | 10/1978 | United Kingdom . | |

OTHER PUBLICATIONS

Lyman, T. ed; Metals Handbook, vol. 2, 8th Ed. Am. Soc. for Metals, p. 547, (1964).

Silman, H. et al. Protective and Decorative Coatings for Metals, p. 556, (1978).

*Primary Examiner*—Veronica O'Keefe

*Attorney, Agent, or Firm*—Cushman, Darby & Cushman

[57] ABSTRACT

A differential multilayer-coated steel strip having an excellent corrosion resistance, enamel-adhering property, seam weldability and drawability and being useful for the production of cans, comprising (A) a steel strip substrate;

(B) a first surface coating formed on a surface of the substrate and comprising (a) a plated nickel first base layer formed on the substrate surface and consisting of from 10 to 5,000 mg/m$^2$ of plated nickel, (b) a plated tin intermediate layer formed on the first base layer surface and consisting of from 50 to 11,000 mg/m$^2$ of plated tin, and (c) a chromium-plated first surface layer formed on the intermediate layer surface and having a weight of from 3 to 50 mg/m$^2$, in terms of metallic chromium; and (C) a second surface coating formed on the other surface of the substrate and comprising (d) a plated nickel second base layer formed on the other surface of the substrate and consisting of from 10 to 5,000 mg/m$^2$ of plated nickel, and (e) a chromium-plated second surface layer formed on the second base layer surface and having a weight of from 3 to 50 mg/m$^2$, in terms of metallic chromium.

8 Claims, 7 Drawing Figures

STEEL STRIP HAVING DIFFERENTIATED MULTILAYER COATINGS AND BEING USEFUL FOR MANUFACTURING OF CANS

FIELD OF THE INVENTION

The present invention relates to a steel strip having differentiated multilayer coatings and being useful for manufacture of cans. More particularly, the present invention relates to a steel strip having a multilayer coating having excellent paintability and seam weldability and being adequate for forming an outside surface layer of a can and a different multilayer coating having excellent corrosion resistance and drawability (two-piece can formability) and being adequate for forming an inside surface layer of a can and, therefore, being useful for producing cans.

BACKGROUND OF THE INVENTION

It is known that conventional surface-treated steel strip usable for producing cans include electrolytically tin-plated steel strips, hereinafter referred to as tin plates, and electrolytically chromium-treated steel strips, hereinafter referred to as TFS-CTs.

In the above-mentioned types of steel strips, the tin plates are mostly typical surface-treated steel strip usable for producing cans and are most widely used for cans. That is, the tin plates, which may be painted or not painted, are widely used for producing food (sanitary) cans for containing fish, meat, soups or fruits therein, beverage cans for containing carbonated bevarages or fruit juices therein, 18 liter cans and pails, since the tin plates exhibit an excellent resistance to corrosion. The tin plates are used for producing not only there-piece cans but also two-piece cans which are widely used to contain beverages therein because the plated tin exhibits an excellent solid lubricating property.

TFS-CTs are mainly used to produce bevarage cans for containing bevarages therein having a relatively low corroding property, 18 liter cans and pails. Usually, TFS-CTs are used to produce three-piece cans but are not used to produce two-piece cans because the chromium-treated layer comprising mainly metallic chromium and hydrated chromium oxide is hard and brittle and, therefore, it is difficult to convert TFS-CTs into two-piece cans. Also even if TFS-CTs can be converted into two-piece cans, the resultant cans exhibit a remarkably decreased resistance to corrosion. When TFS-CTs are used to produce three-piece cans, the side seam bonding of the cans is usually effected by using a bonding material. If the side seam bonding of the cans is carried out by a seam welding process, it is necessary to remove the chromium-treated layer from TFS-CTs by means of grinding. Therefore, the seam welding process is usually not used in the case of TFS-CTs.

As stated above, the tin plates and TFS-CTs should be used for a specific use in which the characteristic properties thereof are beneficially utilized. For example, the tin plates are adequate for producing three-piece cans, which are produced by a conventional can-forming method which does not include the bonding method, and two-piece cans for containing therein materials, to be stably stored for a long period of time.

TFS-CTs are adequate for producing by the bonding method, three-piece cans for containing therein materials to be stored for a relatively short period of time.

Recently, since the price of tin has increased, it has become necessary to decrease the cost of production of tin plates and to conserve tin. For this purpose, attempts have been made to make the thickness of the tin layer in the tin plates smaller. A thin tin layer results in a decrease in the corrosion resistance of the tin plate. This diadvantage can be overcome by painting conventional plain tin plates. Accordingly, these is a tendency to replace conventional plain tin plates with painted tin plates. Also, TFS-CTs can be used in some cases in which conventional tin plates are used.

There is a tendency to increase the production of two-piece cans. Also, in the production of three-piece cans there is a tendency to use the seam welding method rather than the conventional soldering method.

In the case of recent tin plates, the weight of the plated tin is about 2.8 g/m$^2$, which weight seems to be the lower limit of the weight of the plated tin layer necessary for enabling the layer to exhibit a satisfactory solid lubricating property in the formation of two-piece cans. However, weight of 2.8 g/m$^2$ of the plated tin layer is not sufficient for enabling the layer to exhibit a satisfactory corrosion resistance. Accordingly, in the case of three-piece cans, the plated tin layer is usually painted before the can-forming procedure is carried out. Also, in the case of two-piece cans, the plated tin layer is usually painted after the can-forming procedure is carried out.

When TFS-CTs are used in place of tin plates, it is necessary that the entire surfaces of the TFS-CTs be painted. TFS-CTs are not adequate for producing cans for containing fruit juice therein since fruit juice is highly corrosive, or for containing materials therein which should be protected from iron ions derived from the can. Also, TFS-CTs are not adequate for producing two-piece cans which have been widely used in recent years. Therefore, the replacement of tin plates by TFS-CTs is not always acceptable.

As stated above, it is impossible to find a material for producing cans which is satisfactory in respect to corrosion resistance, paintability, formability, weldability and other properties necessary for cans.

For the purpose of decreasing the amount of tin to be plated on the steel strip surfaces, it has been attempted to place a plated nickel layer between the surface of the steel strip and the plated tin layer.

For example, Japanese Patent Application Publication No. 43-12246 discloses a tin-plated steel strip in which steel strip surfaces are base plated with a nickel or nickel-tin alloy layer in an amount of from 10 to 100 mg per m$^2$ of each surface of the steel strip and then the surfaces of the base plated layers are plated with tin the plated steel strip is and reflowed. The tin-plated steel strip exhibits a satisfactory alloy-tin couple test value (ATC Value) which is a parameter of corrosion resistance. However, the above-mentioned reference contains no description concerning the paintability and weldability of the resultant tin-plated steel strip and the resultant tin-plated steel contains a considerably large amount of tin because both surfaces of the steel strip are plated with tin.

Japanese Patent Application Laid-open No. 49-119836 discloses a tin-plated steel strip in which a steel strip is base plated with a metallic nickel or copper layer having a thickness of from 0.005 to 1.0 micron and then surface plated with a tin layer having a thickness of from 0.1 to 2.0 microns without forming an alloy layer between the base layer and the surface layer. The above-mentioned reference states that the resultant tin-plated steel strip exhibits excellent paintability and corrosion resistance after being subjected to a draw and ironing (D.I) formation procedure. The reference, however, is completely silent as to the paintability and weldability when the tin-plated steel strip is used to produce three-piece cans. Also, the tin cost in the production of the tin-plated steel strip is high since the tin-plating is applied to both surfaces of the steel strip.

The above-mentioned two prior arts are effective for decreasing the amount of tin to be applied to the steel strip by preliminarily plating the steel strip with nickel or copper and the resultant products are usable for producing specific cans for limited use. The above-mentioned prior arts, however, failed to provide low cost materials for the production of cans which are satisfactory in respect to corrosion resistance, paintability formability, weldability and other properties necessary for producing cans.

SUMMARY OF THE INVENTION

An object of the present invention is to provide a steel strip having differentiated multilayer coatings and being useful for the manufacture of cans, which steel strip is satisfactory in respect to corrosion resistance, paintability, can-side formability, seam weldability and two-piece can formability.

Another object of the present invention is to provide a steel strip having differentiated multilayer coatings and being useful for the manufacture of cans, which steel strip can be produced at a low cost.

The above-mentioned objects can be attained by the steel strip of the present invention which has differentiated multilayer coatings and is useful for the manufacture of cans, which steel strip comprises:

(A) a steel strip substrate;

(B) a first surface coating formed on a surface of the steel strip substrate and comprising (a) a plated nickel first base layer formed on the surface of the substrate and consisting of from 10 to 5000 mg/m$^2$ of plated nickel, (b) a plated tin intermediate layer formed on the surface of the first base layer and consisting of from 50 to 11,000 mg/m$^2$ of plated tin, and (c) a chromium-plated first surface layer formed on the surface of the intermediate layer and having a weight of from 3 to 50 mg/m$^2$, in terms of metallic chromium; and (C) a second surface coating formed on the other surface of the steel strip substrate and comprising (d) a plated nickel second base layer formed on the other surface of the substrate and consisting of from 10 to 5000 mg/m$^2$ of plated nickel, and (e) a chromium-plated second surface layer formed on the surface of the second base layer and having a weight of from 3 to 50 mg/m$^2$, in terms of metallic chromium.

DETAILED DESCRIPTION OF THE INVENTION

The steel strip of the present invention comprises a steel strip substrate, a first (three layer) surface coating formed on a surface of the steel strip substrate and comprising three metallic layers superimposed on each other, and a second (two layer) surface coating formed on the other surface of the steel strip substrate and comprising two metallic layers superimposed on each other.

The above-mentioned type of steel strip having surface coatings different from each other will be referred to hereinafter as a differential multilayer-coated steel strip.

Figure 1:
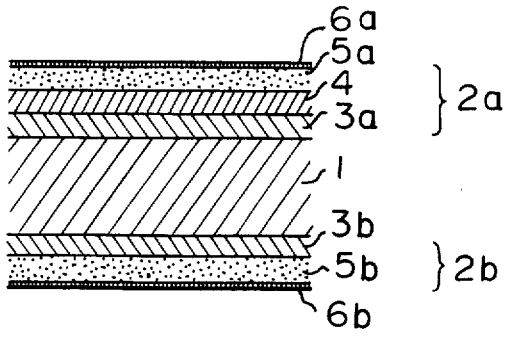
FIG. 1 shows an explanatory cross-sectional structure of an embodiment of the steel strip of the present invention having multilayer coatings different from each other and being usable for the manufacture of cans.

Referring to FIG. 1, the first (upper) surface of a substrate 1 consisting of a cold-rolled steel strip is coated with a first surface coating 2a. The second (lower) surface of the substrate 1 is coated with a second surface coating 2b. The first surface coating 2a consists of a plated nickel first base layer 3a, a plated tin intermediate layer 4 and a chromium-treated first surface layer 5a. The second surface coating 2b consists of a plated nickel second base layer 3b and a chromium-treated second surface layer 5b.

The plated nickel base layers 3a and 3b can be formed by any of the conventional plating methods, for example, the electrolytic and chemical plating methods, as long as the weight of the base layers is in the range of from 10 to 5,000 mg/m$^2$.

The plated tin intermediate layer 4 can also be formed by any of the conventional plating methods, for example, the electrolytic and chemical plating methods, as long as the weight of the intermediate layer is in the range of from 50 to 11,000 mg/m$^2$. However, the tin intermediate layer is usually formed by means of the electrolytic plating method.

The chromium-treated surface layers 5a and 5b have a weight of from 3 to 50 mg/m$^2$ in terms of metallic chromium. The surface layers 5a and 5b may comprise metallic chromium, crystalline chromium oxide and/or amorphous hydrated chromium oxide and can be prepared by carrying out an electrolytic chromium-plating procedure and/or an electrolytic chromic acid-treating procedure.

Usually, the surfaces of the chromium-treated surface layers 5a and 5b are coated with oil film layers 6a and 6b by means of an electrostatic oiling method which is used for conventional tin plates. The oil film layers 6a and 6b are usually formed from cotton seed oil, dibutyl sebacate and/or dioctyl sebacate. Each of the chromium-treated surface layers 5a and 5b may be composed of a single chromium-containing layer or of a plurality of chromium-containing layers.

Figure 2:
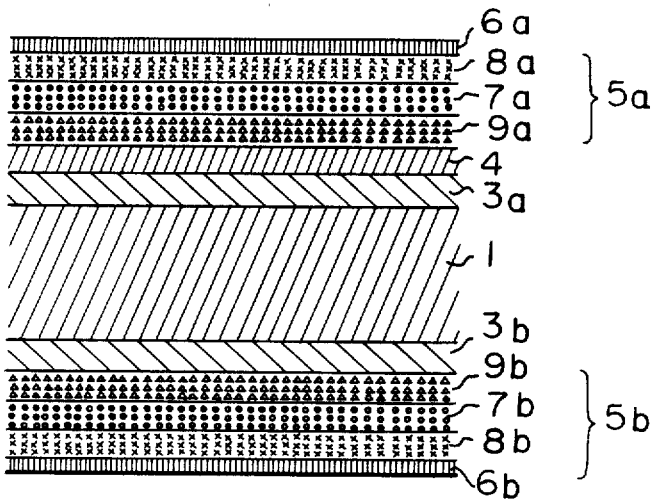
FIG. 2 shows an explanatory cross-sectional structure of another embodiment of the differentially multilayer-coated steel strip of the present invention.

Referring to FIG. 2, the chromium-treated first surface layer 5a is composed of a metallic chromium layer 9a formed on the surface of the intermediate layer 4, a crystalline chromium oxide layer 7a formed on the surface of the metallic chromium layer 9a, and an amorphous hydrated chromium layer 8a formed on the crystalline chromium oxide layer 7a. The above-mentioned superimposed three layers can be produced by means of an electrolytic chromium treatment carried out in a single procedure or in two or more repeated procedures. That is, the three layers may be simultaneously produced by means of a single chromium treatment procedure or may be sequentially produced by means of three or more chromium treatment procedures.

The chromium-treated second surface layer 5b is composed of a metallic chromium layer 9b, a crystalline chromium oxide layer 7b and an amorphous hydrated chromium oxide layer 8a.

In the differential multilayer-coated steel strip of the present invention, the plated nickel base layers are formed in an amount of from 10 to 5000 mg/m$^2$ on the surfaces of the steel strip substrate which has been degreased and pickled. If the amount of the nickel base layers is less than 10 mg/m$^2$, the nickel base layers are sometimes defective to an extent that the defects can not be completely covered by the plated tin intermediate layer, the chromium-treated surface layer and/or a pointed layer formed on the chromium-treated surface layer. Therefore, the resultant product exhibits a poor resistance to corrosion. If the amount of the nickel base layers is more than 5,000 mg/m$^2$, the resultant product is not only undesirably expensive but also exhibits a reduced seam weldability when the resultant product is used to produce cans by means of the can side-seam welding method.

The nickel base layers may be produced by any of conventional electrolytic nickel-plating methods. The thicknesses of the nickel first and second base layers are variable depending on the use, can-forming method and necessary properties of the can and may be different from each other or the same as each other.

In the case where the differential multilayer-coated steel strip of the present invention is converted into a can so that the inside surface of the can is formed by the surface of the first coating, which is composed of three layers, of the steel strip, and the outside surface of the can is formed by the surface of the second coating, which is composed of two layers, of the steel strip, it is preferable that the amount of the nickel base layer in the second coating be 100 mg/m$^2$ or more so that the outside surface of the can exhibits a satisfactory corrosion resistance and that the amount of the nickel base layer in the first coating be in the range of from 10 to 1000 mg/m$^2$. Especially, when the can is a drawn type can (D1 can), it is preferable that the amount of the nickel base layer in the second coating be 300 mg/m$^2$ or more. When the differential multilayer-coated steel strip of the present invention is converted to a can in such a manner that the surface of the second coating of the steel strip forms the inside surface of the can, it is preferable that the amounts of the nickel base layers be in the range of from 100 to 5,000 mg/m$^2$ on the inside surface of the can and in the range of from 10 to 1,000 mg/m$^2$ on the outside surface of the can.

In the first coating of the differential multilayer-coated steel strip of the present invention, the nickel base layer is coated with 50 to 11,000 mg/m$^2$, preferably 500 to 11,000 mg/m$^2$, of a plated tin intermediate layer. If the amount of the tin intermediate layer is less than 50 mg/m$^2$, this thin tin layer does not substantially contribute to enhancement of the corrosion resistance of the resultant steel strip. Also, in the sequential reflow procedure and/or paint-curing procedure, almost all of the tin in the thin tin layer is alloyed with iron in the steel strip substrate and with nickel in the nickel base layer. The tin-iron alloy or the tin-nickel alloy cause the surface of the resultant product to exhibit an undesirable color.

If the amount of the tin intermediate layer is more than 11,000 mg/m$^2$, the resultant product is undesirably expensive and exhibits a poor enamel-adhering property after a painting procedure is carried out. Also, when a seam welding procedure is applied to the coated steel strip having a thick tin intermediate layer, a tin-iron alloy layer having an excessively large thickness and exhibiting an increased undesirable brittleness is formed in the first coating so as to cause the seam-welded portion of the coated steel strip to exhibit a poor paint-adhering property.

In the case where the coated steel strip is converted to a can by using a solder so that the outside surface of the can is formed by the surface of the first coating of the coated steel strip, it is preferable that the amount of the tin intermediate layer be 1,000 mg/m$^2$ or more but not more than 11,000 mg/m$^2$.

In the differential multilayer-coated steel strip of the present invention, it is important that the tin intermediate layer be placed only in the first coating on the steel strip substrate. This feature is effective not only for decreasing the entire amount of tin in the coated steel strip but also for enhancing the drawability and corrosion resistance of the coated steel strip due to the tin intermediate layer superimposed on the nickel base layer. Also, the combination of the nickel base layer and the tin intermediate layer results in an enhanced paintability and in an excellent corrosion resistance after the coating steel strip is coated with a paint.

The surfaces of the tin intermediate layer in the first coating and of the nickel base layer in the second coating are coated with chromium-treated surface layers in an amount of 3 to 50 mg/m$^2$. If the amount of each chromium-treated surface layer is less than 3 mg/m$^2$, the resultant thin surface layer exhibits substantially no effect in respect to the sealing of pin holes in the nickel bore layer and/or the tin intermediate layer and exhibits an unsatisfactory enamel-adhering property when a can enamel is applied onto a paint layer formed on the first coating or the second coating. If the amount of each chromium-treated surface layer is more than 50 mg/m$^2$, the resultant thick surface layer causes the resultant coated steel strip to exhibit a poor seam weldability and an unsatisfactory solderability.

It is preferable that the amount of each chromium-treated surface layer be in the range of from 5 to 20 mg/m$^2$.

In the case where it is necessary that the coated steel strip exhibit a high corrosion resistance, it is preferable that each chromium-treated surface layer be composed of a metallic chromium layer, a crystalline chromium oxide layer and an amorphous hydrated chromium oxide layer superimposed on each other in the manner as indicated in FIG. 2. This type of chromium-treated surface layer can be produced by means of an electrolytic chromic acid treatment in the following manner.

A tin intermediate layer surface of a first coating and a nickel base layer surface of a second coating formed on a steel strip substrate are subjected to an electrolytic treatment in an electrolytic treating liquid containing chromic anhydride ($CrO_3$) as a principal component and $SO_4^-$ ions and $HS^-$ ions as auxiliary components. In this treatment, the coated steel strip serves as a cathode. By the above-mentioned type of electrolytic chromic acid treatment, the three layers, that is, the metallic chromium layer, the crystalline chromium oxide layer and the amorphous hydrated chromium oxide layer, are simultaneously formed.

In another method, the tin intermediate layer surface in the first coating and the nickel base layer surface in the second coating on the steel strip substrate are firstly electroplated with a metallic chromium layer and are secondly simultaneously coated with a crystalline chromium oxide layer and then with an amorphous hydrated chromium oxide layer by means of an electrolytic chromic acid treatment.

The methods for forming the chromium-treated surface layer consisting of the three layers are not limited to specific methods as long as the resultant metallic chromium layer, crystalline chromium oxide layer and amorphous hydrated chromium oxide layer are formed in the above-mentioned sequence on the tin intermediate layer surface or the nickel base layer surface.

In the three-layer chromium-treated surface layer, it is preferable that the metallic chromium layer have a weight of from 0.1 to 20 mg/m$^2$ and that the sum of the crystalline chromium oxide layer and the amorphous hydrated chromium oxide layer have a weight of from 1 to 10 mg/m$^2$ in terms of metallic chromium. A metallic chromium layer having a weight of less than 0.1 mg/m$^2$ sometimes exhibits an unsatisfactory sealing effect for pin holes in the nickel base layer and/or the tin intermediate layer and a poor enamel-adhering property when a can enamel is applied to a painted surface thereof. Also, if the weight of the metallic chromium layer is more than 20 mg/m$^2$, the resultant coated steel strip sometimes exhibits a poor seam weldability and an unsatisfactory solderability.

If the sum of the weights of the crystalline chromium oxide layer and the amorphous hydrated chromium oxide layer is less than 1 mg/m$^2$ in terms of metallic chromium, the resultant coated steel strip sometimes exhibits a poor corrosion resistance and enamel-adhering property. If the sum of the weights of the crystalline oxide layer and the amorphous hydrated chromium oxide layer is more than 10 mg/m$^2$ in terms of metallic chromium, the resultant product sometimes exhibits an unsatisfactory seam weldability and a decreased solderability.

The specific features and advantages of the differential multilayer-coated steel strip of the present invention will be illustrated by the following application examples.

Various types of applications of the coated steel strip of the present invention are indicated in Table 1.

TABLE 1

| Application Example No. | Type of can | Can side bonding method | Necessary properties: Can inside | Necessary properties: Can outside | Type of coating: Can inside | Type of coating: Can outside |
|---|---|---|---|---|---|---|
| 1 | Three-piece can | Seam welding | Corrosion resistant and paint corrosion resistant | Paintable and seam weldable | Ni—Sn—OxCr*1 or Ni—Sn—MCr*2—OxCr (First coating) | Ni—OxCr or Ni—MCr—OxCr (Second coating) |
| 2 | Two-piece can | — | Corrosion resistance and paint corrosion resistance | Paintable D.I formable | Ni—Sn—OxCr*1 or Ni—Sn—MCr*2—OxCr (First coating) | Ni—OxCr or Ni—MCr—OxCr (Second coating) |
| 3 | Three-piece can | Soldering and seam welding | — | Corrosion resistant, paint corrosion resistant, seam weldable and solderable | Ni—OxCr or Ni—MCr—OxCr (Second coating) | Ni—Sn—OxCr or Ni—Sn—MCr—OxCr (First coating) |
| 4 | Two-piece can | — | — | Drawable, corrosion resistant and paint corrosion resistant D.I formable | Ni—OxCr or Ni—MCr—OxCr (Second coating ) | Ni—Sn—OxCr or Ni—Sn—MCr—OxCr (First coating) |

Note:
*1OxCr — Crystalline chromium oxide layer and amorphous hydrated chromium oxide
*2MCr — Metallic chromium layer Application Examples 1 and 2

In Application Example 1, four different types of coated steel strips A, B, C and D of the present invention indicated in Table 2 were used to produce three-piece cans by means of seam welding in such a manner that in each can the inside surface of the can was formed by the first coating (Ni-Sn-Cr) surface of the coated steel strip and the outside surface of the can was formed by the second coating (Ni-Cr) surface of the coated steel strip. In this case, it was necessary that the inside surface of the can exhibit an excellent resistance to corrosion of not only the non-painted plain surface thereof but also the painted surface thereof.

Further, it was necessary that outside surface of each can exhibit satisfactory paintability and seam weldability.

In Application Example 2, the same coated steel strips as those described in Application Example 1 were converted to two-piece cans.

In each can, it was necessary that the inside surface thereof exhibit an excellent resistance to corrosion of the non-painted plain surface and the painted surface thereof.

Also, it was necessary that the outside surface of each can have an improved paintability.

The corrosion resistance of the first coatings of the four types of coated steel strips of the present invention used in Application Examples 1 and 2 was measured by means of the ATC test and by means of the ISV test, which will be explained hereinafter, in order to compare them with conventional tin plate No. 25 having plated tin layers in a weight of 2.8 g per $m^2$ of each surface of a substrate thereof and tin plate No. 100 having plated tin layers in a weight of 11.2 g per $m^2$ of each surface of a substrate thereof.

The results of the tests are indicated in Table 2.

TABLE 2

| Type of coated steel strip | Coated steel strip ($mg/m^2$) First coating: Ni base layer | First coating: Sn intermediate layer | First coating: Cr-treated* surface layer | Second coating: Ni base layer | Second coating: Cr-treated* surface layer | ATC test ($\mu A/cm^2$) | ISV test ($\mu g/3\ in^2$) |
|---|---|---|---|---|---|---|---|
| A | 300 | 600 | 10 | 300 | 10 | 0.023 | — |
| B | " | 1200 | 10 | " | 10 | 0.018 | 12.6 |
| C | 600 | 2700 | 10 | 600 | 10 | 0.021 | 6.1 |
| D | " | 5500 | 10 | " | 10 | 0.020 | 5.6 |
| Tin plate No. 25 | | Sn: 2800 | 5 | Sn: 2800 | 5 | 0.092 | 10.5 |
| Tin plate No. 100 | | Sn: 11000 | 5 | Sn: 11000 | 5 | 0.055 | 6.4 |

*in terms of metallic chromium

ATC Test

The ATC (alloy-tin-couple) test is effective for evaluating the resistance of a metallic material to corrosion due to an acid liquid. A specimen to be tested was detinned to form an alloy layer. The alloy layer of the detinned specimen was coupled with a pure tin anode in grapefruit juice while the testing system was placed in an oxygen-free nitrogen atsmophere so as to generate a small galvanic current between the alloy layer and the pure tin anode. The galvanic current was measured as an ATC current.

The smaller the measured galvanic current, the higher the resistance of the specimen to acid corrosion.

ISV Test

An ISV (iron solution value) test is usually used in the case of tin plates to evaluate the corrosion resistance thereof. A specimen was immersed in a testing solution containing sulfuric acid. The concentration of sulfuric acid was predetermined so that the tin would exhibit an anodic property slightly higher than that of the steel in the testing solution. The amount of iron dissolved in the testing solution was measured.

Table 2 clearly shows that the coated steel strip C having 2,700 $mg/m^2$ of a tin intermediate layer with a weight similar to the weight of the tin layer in the tin plate No. 25 exhibited an excellent corrosion resistance similar to that of the tin plate No. 100, which has tin layers in a large weight of 11,000 $mg/m^2$.

Table 2 also shows that the coated steel strips A and B having a tin intermediate layer in an amount of 1,200 $mg/m^2$ or less exhibited a corrosion resistance higher than that of the tin plate No. 25 having 2,800 $mg/m^2$ of tin layers.

From the above facts, it is evident that the differential multilayer-coated steel strip of the present invention has an excellent corrosion resistance as compared with that of conventional tin plates and is effective for conserving tin.

The differential multilayer-coated steel strip is useful for producing cans in which the inside surfaces are painted so that the inside surfaces of the cans are formed by the first coating (Ni-Sn-Cr) surface of the coated steel strip of the present invention.

Hitherto, inside-painted cans were produced from conventional tin plates or TFS-CTs. However, conventional tin plates having less than 2.8 $g/m^2$ of tin layers and TFS-CTs are not adequate for the manufacture inside-painted cans to be used for containing therein fruit juices which have a high corroding property or fish or other foods which must be stored for a long period of time. Accordingly, only conventional tin plates having plated tin layers in a weight of 2.8 $g/m^2$ or more can be used to produce inside-painted cans. Conventional TFS-CTs, which exhibit a relatively poor corrosion resistance, are usually used to produce cans for containing therein materials which are not stored for a long period of time.

The differential multilayer-coated steel strip of the present invention is useful for producing inside-painted cans having an excellent enamel-adhering property, which is absent in conventional tin plates, and is effective for significantly conserving tin.

When the coated steel strip of the present invention is used to produce inside-painted cans so that the inside surfaces of the cans are formed by the surface of the first coating of the coated steel strip, the nickel base layer and the tin intermediate layer may be in a relatively small weight of 500 $mg/m^2$ and 1,500 $mg/m^2$, respectively, because the outer surfaces of the insides of the cans are prevented from corroding by the paint layers. An increase in the weight of the nickel base layer and the tin intermediate layer to more than 500 $mg/m^2$ and to more than 1,500 $mg/m^2$, respectively, is not effective for enhancing the corrosion resistance of the coated steel strip and results in an economical disadvantage, in poor paintability, and in a poor enamel-adhering property.

When the differential multilayer-coated steel strip of the present invention is used to produce inside-painted cans so that the inside surfaces of the cans are formed by the surface of the first coating of the coated steel strip in order to enhance the resistance of the painted, coated steel strip to corrosion, it is preferable that the weight of the tin intermediate layer be limited to within a specific range determined in consideration of the weight of the nickel base layer, as described below.

That is, it is preferable that the weight, x g/m$^2$, of the tin intermediate layer and the weight, y g/m$^2$, of the nickel base layer satisfy the following relationships:

$$y \geqq 0.08x^2 + 001$$

$$y \geqq -x + 0.2$$

$$y \leqq x$$

$$y \leqq 0.5$$

$$x \leqq 1.5$$

more preferably, $$y \geqq 0.08x^2 + 001$$

$$y \leqq x - 0.2$$

$$y \leqq 0.3$$

$$x \leqq 1.0$$

When the above relationships are satisfied, the resultant coated steel strip of the present invention exhibits an excellent resistance of the painted surface thereof to corrosion.

The preferable ranges of the weights of the tin intermediate layers and the nickel base layers were determined by subjecting a number of different types of coated steel strips to the UCC (Under Cutting Corrosion) test and the sulfide stain test, which tests will be explained below.

UCC Test

A coated steel strip was coated with 45 mg/dm$^2$ of an epoxy phenol paint. The paint layer was cured at a temperature of 205° C. for 10 minutes and then was additionally cured at a temperature of 180° C. for 10 minutes. Twenty-four hours after the paint coating procedure was carried out, test specimens were prepared from the painted steel strip. The surface of a specimen was scratched with a knife. Then the scratched specimen was immersed for 3 days in a corroding aqueous liquid containing 1.5% by weight of citric acid and 1.5% by weight of sodium chloride at a temperature of 50° C. in a carbon dioxide gas atmosphere. After the specimen was removed from the corroding liquid, washed with water and then dried, an adhesive tape was adhered to the scratched portion of the specimen and then peeled. The scratched portion of the specimen was observed to determine how the portion was corroded.

Sulfide Stain Test

The same type of specimen as that used for the UCC test was subjected to a sulfide stain test. The center portion of the specimen was protruded by means of an Erichsen testing machine. Then the specimen was placed in a commercial can together with boiled salmon and the can was sealed. The can was subjected to a retort treatment at a temperature of 125° C. for 90 minutes and thereafter was allowed to naturally cool for 24 hours. After removing the specimen from the can, the appearance of the specimen was observed to determine how the specimen was stained.

Figure 3:
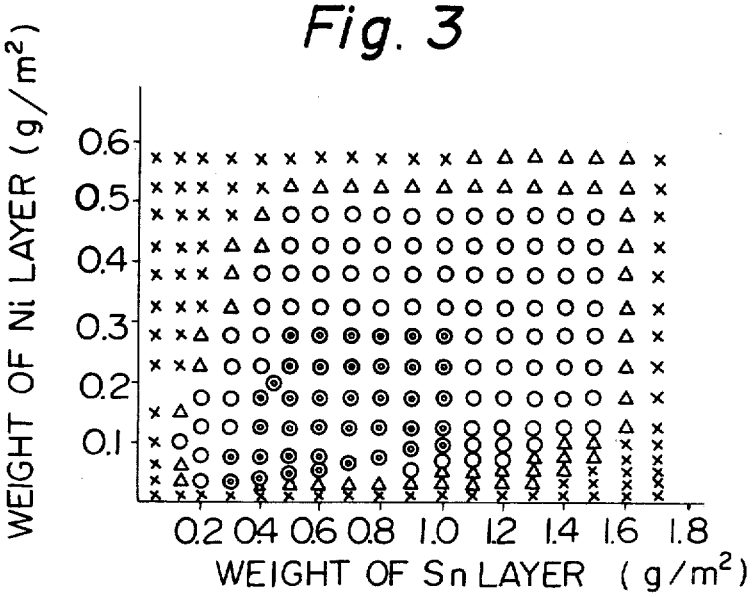
FIG. 3 is a diagram showing a relationship between the corrosion resistance, determined by an undercutting corrosion test, of a three-layer coated, painted inside surface of a can and the amounts of plated nickel base layer and plated tin intermediate layer in the inside surface coating of the can.
Figure 4:
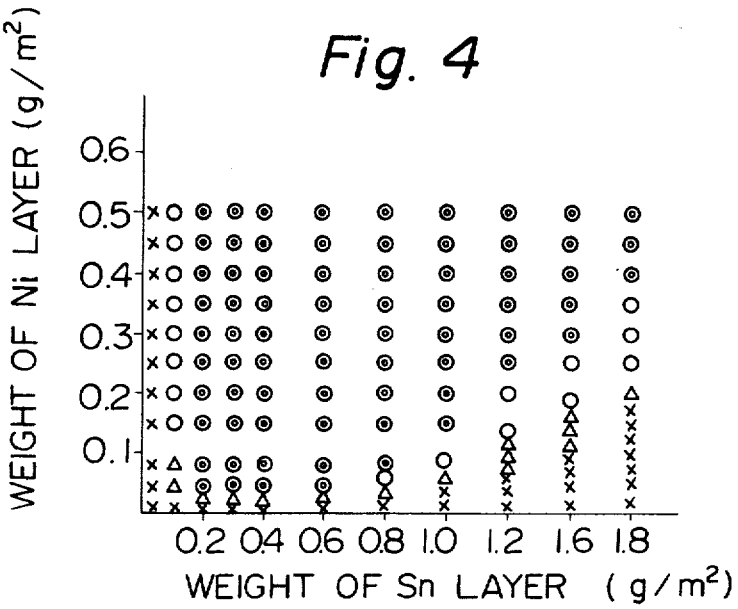
FIG. 4 is a diagram showing a relationship between the corrosion resistance, determined by a sulfide stain test, of a three-layer coated, painted inside surface of a can and the amounts of plated nickel base layer and plated tin intermediate layer in the inside surface coating of the can.

The results of the UCC test are indicated in FIG. 3 and the results of the sulfide stain test are shown in FIG. 4.

In FIGS. 3 and 4, the degrees of corrosion resistance are indicated by the following symbols:

: excellent
: satisfactory
Δ: slightly unsatisfactory
: unsatisfactory

Figure 5:
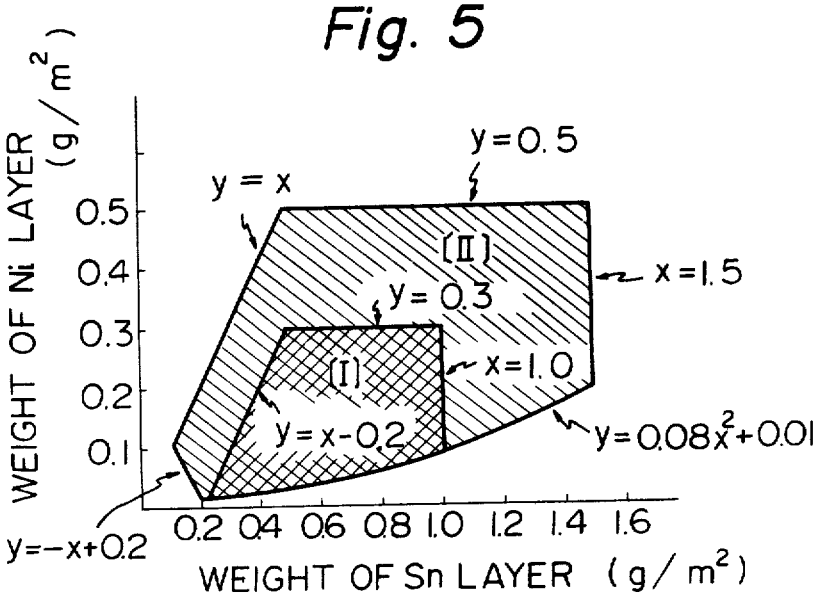
FIG. 5 is a diagram showing a relationship between the corrosion resistance of the inside surface of the can and the amounts of plated nickel base layer and plated tin intermediate layer in the inside surface coating of the can, summarized from the relationship indicated in FIGS. 3 and 4.

The results of the corrosion tests indicated in FIGS. 3 and 4 are summarized in FIG. 5.

In FIG. 5, the weights of the tin intermediate layer and the nickel base layers at which weights the specimens exhibited an excellent corrosion resistance, are in the area [I]. Also the weights of the tin intermediate layer and the nickel base layer, at which weights the specimens exhibited a satisfactory corrosion resistance, are in the area [II]. The straight lines and curve by which the area II is defined by the equations.

In the cans described in Application Examples 1 and 2, the outside surfaces of the cans were formed by the surface of the second coating of the coated steel strip of the present invention. The second coating contained no tin layer, which layer is expensive. Therefore, the coated steel strip of the present invention is effective for decreasing the price of cans.

Application Examples 3 and 4

In Application Example 3, a can was produced, by means of a three-piece can-forming method, from a differential multilayer-coated steel strip of the present invention in such a manner that the outside surface of the can was formed by the surface of the first coating (Ni-Sn-Cr) and the inside surface of the can was formed by the surface of the second coating (Ni-Cr) of the coated steel strip.

This type of can was usable for containing therein a material having a relatively poor corroding property. The outside of the can had an enhanced corrosion resistance and a satisfactory gloss. Accordingly, the can was adequate as an aerosol propellant can and could be produced by means of a can-side seam-welding method.

The weights of the first and second coatings and the component layers were variable within the ranges as specified in the present invention, depending on the material to be contained in the can, the environment in which the can is to be used, and the environment in which the can is to be stored. Also, the necessity of applying a paint coating on the can depended on the above-mentioned factors.

If the material to be contained therein was limited to a poor corrosive material, for example, oil, the cans of Application Examples 3 and 4 could be used in place of a conventional can produced from a thin tin plate, for example, the tin plate No. 25 or a TFS-CT. In this case, it is preferable that the weight of the nickel base layer be 500 mg/m$^2$ or more so that the inside of the resultant can exhibits a satisfactory corrosion resistance.

The can of Application Example 3 is usable when it is necessary that the outside surface of the can have an excellent corrosion resistance since the outside surface is formed by the first coating surface of the coated steel strip of the present invention.

In Application Example 4, a differential multilayer-coated steel strip of the present invention was converted to a two-piece can in the same manner as that described in Application Example 3.

The first coating of the coated steel strip used had a nickel base layer having a weight of 300 mg/m$^2$, a tin intermediate layer having a weight of 5,500 mg/m$^2$ and a chromium-treated surface layer having a weight of 15 mg/m$^2$ in terms of metallic chromium.

The outside plain surface of the can was subjected to a salt-solution spraying test in which the spraying time was varied from 2 hours to 100 hours to determine the corrosion resistance thereof. The results of the test are indicated by line 1 in FIG. 6. The same test as mentioned above was used in the case of a tin plate No. 50 can and a tin plate No. 100 can. The results on the tin plate No. 50 and the tin plate No. 100 are indicated by line 2 and by line 3, respectively, in FIG. 6.

Figure 6:
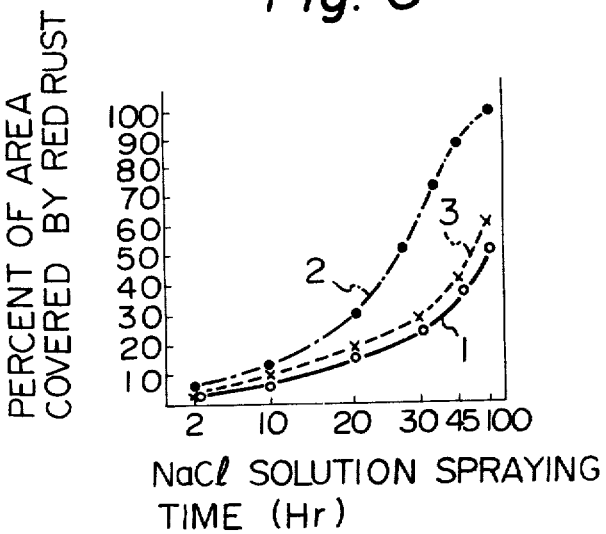
FIG. 6 is a diagram showing a relationships between the corrosion resistance, determined by a salt spray test, of a two-piece can made from a differentially multilayer-coated steel strip of the present invention and the salt solution spraying time, in comparison with the relationship between the corrosion resistance in the case of two different conventional tin plates and the salt solution spraying time.

From FIG. 6, it is evident that the corrosion resistance of the outside surface of the can of Application Example 4 is similar to or superior to the corrosion resistance of the tin plate No. 50 can and the tin plate No. 100 can.

In the two-piece can of Application Example 4, the enhanced press lubricating property of the first coating in the coated steel strip of the present invention was advantageously utilized.

Generally, in the formation of the two-piece can, a coated steel strip is pressed to form a cup by means of a deep drawing procedure and the cup is subjected to a two- or three-step ironing procedure so as to draw and iron the side wall of the cup and form a can. In the ironing procedure, the outside layer of the side wall of the cup is especially strongly drawn and ironed by an ironing die. If a TFS-CT (having plated chromium layers) which is hard and exhibits a poor lubricating property is subjected to the ironing procedure, a number of fine cracks are formed in the chromium layers due to the poor resistance of the chromium layers to the ironing and drawing actions. The fine cracks in the chromium layers result in the resultant can having a poor corrosion resistance. Also, the ironing die is extremely worn by the hard chromium layers. Accordingly, TFS-CTs are not adequate for producing two-piece cans by means of a deep draw-ironing procedure.

When a tin plate (having tin layers) which has a low melting point of 232° C. and an excellent malleability is subjected to the two-piece can-forming process, the tin layers generate heat in the ironing procedure so that they exhibit an excellent solid lubricating effect. Therefore, no cracks are formed in the tin layers and the resultant can exhibits a satisfactory corrosion resistance. Also the degree of wear of the ironing die is small. Accordingly, the tin plate can be easily formed into a two-piece can without difficulty. However, the draw-ironing procedure applied to the tin plate causes the tin layers to become thin and, therefore, unavoidably results in formation of defects in the tin layers. And defects in the tin layers cause the resultant can to have a poor corrosion resistance. In order to avoid the formation of defects, it is necessary to increase the thickness of the tin layer.

By using the differential multilayer-coated steel strip of the present invention to produce cans in such a manner that the outside surface of the can is formed by the first coating (Ni-Sn-Cr) surface of the coated steel strip, it is possible to obtain advantages not only in that the two-piece can-forming process can be readily carried out due to the excellent solid lubricating property of the tin intermediate layer in the first coating of the coated steel strip but also in that the deterioration in corrosion resistance of the outside surface of the resultant can due to the two-piece can-forming procedure can be prevented by the nickel base layer in the first coating of the coated steel strip.

In the two-piece can-forming process as mentioned in Application Example 4, it is important that the tin intermediate layer consist of pure tin so that the ironing procedure can be smoothly carried out due to the excellent solid lubricating property of the pure tin. Accordingly, an Sn-Ni alloy layer should be prevented from forming between the nickel base layer and the tin intermediate layer, which alloy layer makes the solid lubricating property of the tin intermediate layer poor. For this reason, a reflow procedure which promotes the formation of the Sn-Ni alloy layer should not be applied to the coated steel strip to be used for the production of two-piece cans.

As stated in Application Examples 3 and 4, when the differential multilayer-coated steel strip of the present invention is used to produce cans for containing therein a material having a poor corroding property, it is beneficial if the cans are formed in such a manner that the first coating (Ni-Sn-Cr) of the coated steel strip forms the outside surfaces of the cans. In such a case, the inside surfaces of the cans are formed by the second coating containing nickel which is not expensive. Therefore, the cans can be produced at a low cost. Also, the tin intermediate layer in the first coating serves as a solid lubricant in the draw-ironing procedure.

The differential multilayer-coated steel strip of the present invention can be produced by the process as illustrated below.

The type of steel strip substrate can be selected from various cold-rolled steel strips in consideration of the use and necessary properties of the resultant coated steel strip. Usually, the steel strip substrate can be selected from cold-rolled steel strips usable for producing conventional tin plates and TFS-CTs.

Figure 7:
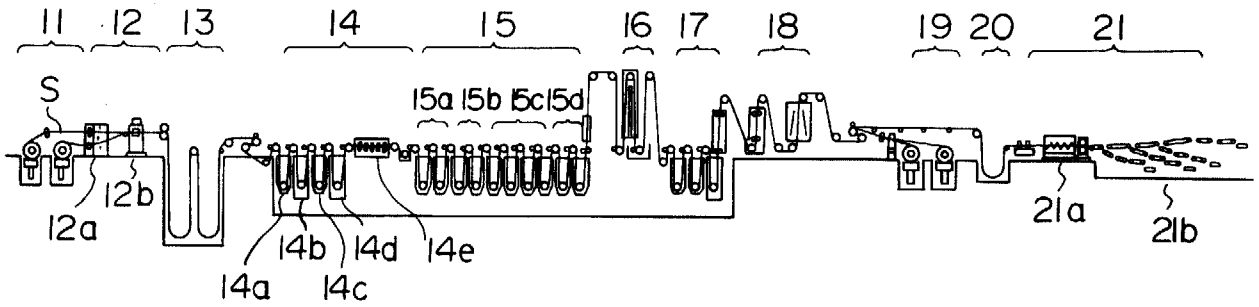
FIG. 7 is an explanatory cross-sectional view of an apparatus for producing the differentially multilayer-coated steel strip of the present invention.

The coated steel strip of the present invention can be continuously produced, for example, by means of a usual continuous electrolytic tin plate-producing process by using the apparatus as indicated in FIG. 7.

A cold-rolled steel strip substrate S is supplied from a coil by means of an uncoiler 11 to an inlet handler 12 which comprises a shearing machine **12*a* and a seam welder 12*b*. The sheared, welded steel strip substrate S is forwarded through an inlet looper 13 to a plating pre-treatment apparatus 14 which comprises a degreasing vessel 14*a*, a washing vessel 14*b*, a pickling vessel 14*c*, a washing vessel 14*d* and a scrubber 14*e*. The pretreated strip S is introduced into a plating apparatus 15 which comprises two nickel-plating vessels 15*a*, two dragout vessels 15*b*, four tin-plating vessels 15*c* and two dragout vessels 15*d*. The plated strip S is forwarded through a reflow apparatus 16 to a chemical treatment apparatus 17. The chemical-treated strip S is oiled in an oiling apparatus 18 and then recoiled by means of a recoiler 19. The oiled strip S may be forwarded through an outlet looper 20 to an outlet handler 21 which comprises a shearing machine 21*a* and pilers 21*b***.

When the pretreated strip S is introduced into the plating apparatus 15, both surfaces of the pretreated strip S are plated with 10 to 5,000 mg/m$^2$ of nickel. In the nickel-plating vessels **15*a***, usually, contamination of the plated nickel layer by a small amount of impurities such as sulfur, phosphorus and zinc is unavoidable, and such contamination causes a decrease in the corrosion resistance of the resultant coated steel strip. When the impurities and a portion of the nickel layer are dissolved in the contents of the can, the corrosion resistance of the can is reduced. Accordingly, in the conventional nickel plating process, the composition, temperature and concentration of the plating liquid and plating current density are carefully controlled so as to prevent the nickel layer from being contaminated by the impurities. In the production of the differential multilayer-coated steel strip of the present invention, however, since the dissolution of the impurities and nickel in the contents of the can can be restricted by the tin intermediate layer placed on the nickel layer by forming the inside surface of the can with the first coating (Ni-Sn-Cr) surface of the coated steel strip, control of the nickel-plating procedure is made easy.

The composition of the nickel-plating liquid usable for the present invention is not limited to a specific composition. The nickel-plating liquid may be a usual watt's bath, a sulfamic acid bath, a sulfuric acid bath, or an other type of nickel-plating bath.

The nickel-plated strip S is washed with water in the dragout vessel **15*b* so as to recover the nickel-plating liquid and the washed strip S is introduced into the tin-plating vessels 15*c*** so as to plate only one surface of the strip with 50 to 11,000 mg/m$^2$ of tin. The method for plating one surface of the strip with tin is not limited to a special method. That is, the tin-plating procedure can be effected by any of the conventional tin electro-plating methods for tin plates. For example, the tin-plating procedure can be carried out by using a tin-plating liquid containing phenolsulfonic acid which is a usual liquid used in the ferrostan line. If the tin-plating procedure is carried out in an alkali line, the plating liquid contains sodium stannate or potassium stannate. If a halogen line is used for the tin-plating procedure, the plating liquid contains tin chloride.

Since only one surface is plated with tin, which is expensive, the differential multilayer-coated steel strip of the present invention can be produced at a lower cost than conventional tin plates, both surfaces of which are plated with expensive tin.

The tin-plating liquid remaining on the surface of the tin-plated strip is washed and recovered in the dragout vessel **15*d***.

If necessary, the tin-plated surface of the strip S can be differentiated from the non-tin-plated surface of the strip S by applying a palm kernel oil or a chemical treatment solution to either of the surfaces, so as to change the gloss of the applied surface, by means of a surface-marking device (not shown in FIG. 7).

However, the tin-plated surface can be easily distinguished from the non-tin-plated surface because the appearance of the tin layer is clearly different from the appearance of the nickel layer. Therefore, the above-mentioned surface-marking procedure can be omitted.

The tin-plated strip S is subjected to a reflow procedure in the reflow apparatus 16, if necessary. In the reflow apparatus 16, the tin layer formed on the nickel layer of the strip S is melted. Since nickel having a melting point of 1,452° C. does not melt at the melting point of tin (232° C.), it is easier to control the melting condition of the tin layer formed on only one surface of the strip S than it is to control that of the conventional tin plate having two tin layers.

The reflow procedure causes the tin layer to become more glossy. Therefore, the reflowed tin layer surface is easily distinguished from the nickel layer surface having a poor gloss.

As stated hereinbefore, when the resultant coated steel strip is subjected to the draw-ironing process, it is preferable that the reflow procedure be omitted.

It is known that the forming rate of the Sn-Fe alloy layer in the reflow procedure is variable depending on the type of steel strip substrate. For example, it is known that the formation rate of the alloy layer on an Al-killed steel is smaller than that on capped steel. However, the Ni-Sn double layer formed on the steel strip substrate is effective for equalizing the Sn-Fe alloy layer-forming rates of various types of steel strip substrates. For example, in the case of the Al-killed steel strip, the Sn-Fe alloy layer can be rapidly formed in the reflow procedure by coating the Al-killed steel strip with the Ni-Sn double layers. This phenomenon causes the ATC value of the resultant coated steel strip to become small, and, therefore, causes the resultant coated steel strip to exhibit an excellent corrosion resistance.

The plated and, optionally, reflowed strip S is subjected to a chromium treatment in the chemical-treatment apparatus 17. In this chromium treatment, the tin intermediate layer in the first coating and the nickel base layer in the second coating are treated electrolytically or chemically with a chromium-containing treatment liquid, for example, containing chromic anhydride, trisodium phosphate and sodium dichromate, to form dense chromium-treated surface layers. When it is desired to obtain a coated steel strip having an excellent resistance to corrosion under a paint layer, it is preferable that the chromium treatment be carried out by means of an electrolytic treatment method. The weight of each chromium-treated surface layer is variable within the range of from 3 to 50 mg/m$^2$ in terms of metallic chromium.

The chromium-treated strip S is oiled with an oiling agent in an oiling apparatus 18 which may be of a conventional electrostatic type for oiling tin plates. The oiling agent usually contains cotton seed oil and/or dioctyl sebacate.

The oiled strip S is coiled by the recoiler 19. The coil is fed to a separate shearing line (not shown in FIG. 7) and is sheared to a desired size. The oiled strip S may be moved to the outlet handler 21 through the outlet looper 20. In the outlet handler 21, the strip S is sheared to a desired size and the resultant pieces of the strip are piled.

The present invention is advantageous in that the differential multilayer-coated steel strip of the present invention can be produced by using a conventional halogen line or alkali line in place of the ferrostan line indicated in FIG. 7. Also, it is an advantage of the present invention that the plating apparatus for producing tin plates can be utilized for the production of the coated steel strip of the present invention only by modifying several upstream tin-plating vessels to nickel-plating vessels and dragout vessels.

Furthermore, it is another advantage of the present invention that the tin layer, which is expensive, is formed on only one surface of the steel strip so as to reduce the cost of the coated steel strip.

Moreover, it is still another advantage of the present invention that used cans which have been produced from the coated steel strip of the present invention can be used in the steel making process without great difficulty because the amount of tin in the used cans is very small and therefore is not harmful for the steel making process.

SPECIFIC EXAMPLES

The following specific examples are presented for the purpose of clarifying the present invention. However, it should be understood that these are intended only to be examples of the present invention and are not intended to limit the scope of the present invention in any way.

In the examples, the properties of the products were measured by the following test methods:

1. NaCl-solution spraying test

An aqueous solution of 3% by weight of NaCl was sprayed onto a surface of a specimen for 44 hours. After the spraying procedure was completed, the area of the specimen covered with red rust produced during the spraying procedure was measured.

2. Tin-dissolving test

A specimen was immersed in commercial orange juice contained in a vessel. The vessel was tightly sealed and stored at a temperature of 37° C. for 6 months. Then the amount of tin dissolved in the orange juice was measured.

3. UCC (Under cut corrosion) test

An epoxyphenol type paint was applied in a weight of 45 mg/m$^2$ to the surface of the first coating (Ni-Sn-Cr) of a specimen, and the paint layer was cured at a temperature of 205° C. for 10 minutes and then at a temperature of 180° C. for 10 minutes. The cured paint layer was scratched with a knife and the scratched specimen was immersed in a corroding solution containing 1.5% by weight of citric acid and 1.5% by weight of sodium chloride at a temperature of 50° C. for 3 days. Thereafter, an adhesive tape was adhered on the scratched paint layer surface and then rapidly peeled. The portions of the paint layer around the scratches were observed to evaluate the resistance of the specimen to corrosion under the paint layer.

4. Enamel adhesion test (A) Primary adhesion test

A specimen was coated in the same manner as that described in the UCC test. The paint-coated specimen was subjected to a cross knife-cut test. The paint layer on the specimen was crosshatched in a checkered pattern so as to form scratches each having a width of 2 mm and a length of 2 mm. An adhesive tape was applied to the crosshatched surface of the specimen and rapidly peeled from the surface. It was determined whether or not a portion of the paint layer was removed from the specimen.

(B) Secondary adhesion test

The paint-coated specimen as mentiond above was subjected to a NaCl retort treatment by using a 3% NaCl aqueous solution at a temperature of 125° C. for 90 minutes.

The treated specimen was subjected to the same cross knife-cut test as mentioned above.

(C) Adhesion test after UCC test

The UCC tested specimen was subjected to the same cross knife-cut test as mentioned above.

5. Seam weldability

An end portion of a specimen having a length of 0.8 mm was superimposed on an end portion of another specimen and the superimposed portions of the specimens were seam-welded under a pressure of 50 kg/cm$^2$ at a secondary side welding current of 4.5 KA. The impact strength of the weld was measured. Separately, the appearance of the weld was evaluated macroscopically.

EXAMPLES 1 THROUGH 7 AND COMPARATIVE EXAMPLES 1 THROUGH 7

In each of Examples 1 through 7 and Comparative Examples 1 through 4, a cold-rolled steel strip having a thickness of 0.22 mm, which strip was used as a substrate, was degreased and pickled by means of a usual method.

Both surfaces of the cleaned steel strip substrate were plated with nickel under the following conditions.

Composition of nickel-plating liquid
- Nickel sulfate ($NiSO_4.6H_2O$): 240 g/l
- Nickel chloride ($NiCl_2.6H_2O$): 45 g/l
- Boric acid ($H_3BO_3$): 30 g/l Temperature of the nickel-plating bath: 50° C.

Current density: 10~50 A/dm$^2$

The current density and the nickel plating time were predetermined so as to attain the weight of the nickel base layer as indicated in Table 3, that is, 5, 150, 300 or 900 mg/m$^2$.

One surface of the nickel-plated substrate was plated with tin under the following conditions:

Composition of tin-plating liquid
- Tin sulfate: 25 g/l
- 65% phenolsulfonic acid: 30 g/l
- Ethoxylated alpha-naphthol sulfuric acid (ENSA): 2 g/l Temperature of the plating bath 40° C.

Current density 10~30 A/dm$^2$

The current density and the plating time were predetermined so as to attain the weight of the tin intermediate layer indicated in Table 3, that is, 40, 600, 1,200, 2,700, or 5,400 mg/m$^2$.

Both surfaces of the plated substrate as mentioned above were treated by means of the chromium treating method indicated in Table 3 so as to attain the weight of the chromium-treated surface layers indicated in Table 3.

The types of chromium-treating methods used were as follows:

Method A

Composition of treating liquid
- Sodium dichromate ($Na_2Cr_2O_7$): 25 g/l

Temperature of treating bath: 40° C.

Current density: 10 A/dm$^2$

The treating time was predetermined so as to form chromium-treated surface layers having the weight indicated in Table 3, that is, 2 or 10 mg/m$^2$ in terms of metallic chromium.

Method B

Composition of treating liquid
- Chromic anhydride ($CrO_3$): 50 g/l
- Sulfuric acid ($H_2SO_4$): 0.4 g/l
  - in terms of $SO_4^{2-}$ Temperature of treating bath: 50° C.

Current density: 10~40 A/dm$^2$

The current density and treating time were predetermined so as to attain the weight of the chromium-treated surface layers indicated in Table 3, that is, 20 or 60 mg/m$^2$ in terms of metallic chromium.

Method C (Two-step treatment)

Composition of the first treating liquid
- Chromic anhydride: 50 g/l
- Sulfuric acid: 0.5 g/l
  - in terms of $SO_4^{2-}$ Temperature of the first bath: 50° C.

Current density: 60~100 A/dm$^2$

The resultant coated steel strip was washed with water and then subjected to a second chromium treatment under the following conditions:

Composition of the second treating liquid
- Chromic anhydride: 50 g/l
- Ammonium fluoride ($NH_4F$): 0.5 g/l Temperature of the second treating bath: 50° C.

Current density: 10~40 A/dm$^2$

The current densities and the treating times in the first and second treatments were predetermined so as to attain the weights of the resultant chromium-treated surface layers indicated in Table 3.

By means of Method C, a three-layer chromium-treated surface layer was formed on each surface of the substrate. The three layer chromium surface layer consisted of 5 mg/m$^2$ of a metallic chromium layer, 3 mg/m$^2$, in terms of metallic chromium, of a crystalline chromium oxide layer and 6 mg/m$^2$, in terms of metallic chromium, of an amorphous hydrated chromium oxide layer.

The results of the tests are indicated in Table 3.

In Comparative Examples 5, 6, and 7, commercial tin plates No. 50 and No. 25 and a TFS-CT were, respectively, subjected to the above-mentioned tests. The tin plate No. 25 had 2,800 mg/m$^2$ of a tin layer, and 10 mg/m$^2$ in terms of metallic chromium, of a chromate-coated layer formed on each surface thereof. The tin plate No. 50 had 5,500 mg/m$^2$ of a tin layer, and 10 mg/m$^2$ in terms of metallic chromium, of a chromate-coated layer formed on each surface thereof. The TFS-CT used had a coating layer comprising 100 mg/m$^2$ of metallic chromium and 12 mg/m$^2$, in terms of metallic chromium, of chromium oxides.

The results of the tests are indicated in Table 3.

From Table 3, it is evident that the corrosion resistance of the coated steel strip in Examples 1 and 2, determined in the NaCl solution spray test and the tin dissolution test, is superior to that of the tin plate No. 50 used in Comparative Example 5.

The corrosion resistance under the paint layer of the coated steel strips in Examples 3 through 7 determined by the UCC test was superior to that of the tin plate No. 25 and the TFS-CT used.

Especially, the corrosion resistance of the coated steel strip in Example 7 was excellent.

The enamel-adhering properties of the coated steel strips in Examples 3 through 7, determined by means of the enamel adhesion test, were superior to the enamel-adhering property of the tin plate No. 25 and were similar to that of the TFS-CT.

The seam weldabilities of the coated steel strips in Examples 3 through 7 were similar to the seam weldability of the tin plate No. 25 and extremely superior to that of the TFS-CT.

In Comparative Example 1, the weight of the nickel base layer fell outside the scope of the present invention. Also, Comparative Example 2, the weight of the tin intermediate layer fell outside the scope of the present invention. Accordingly, the corrosion resistance

TABLE 3

| Example No. | Nickel base layer (mg/m$^2$) | Tin intermediate layer (mg/m$^2$) | Chromium-treated surface layer: Type of treating method | Chromium-treated surface layer: Weight*1 (mg/m$^2$) | NaCl solution spray test: Area covered with red rust (%) | Tin-dissolving test: Amount of dissolved tin (ppm) | UCC test: Condition of corroded strip | UCC test: Evaluation | Enamel adhesion test: Primary test | Enamel adhesion test: Secondary test | Enamel adhesion test: After UCC test | Seam weldability: Impact strength | Seam weldability: Appearance |
|---|---|---|---|---|---|---|---|---|---|---|---|---|---|
| Example 1 | 900 | 2700 | A | 10 | 10 | 80 | — | — | — | — | — | — | — |
| 2 | 900 | 5400 | A | 10 | 0 | 60 | — | — | — | — | — | — | — |
| 3 | 150 | 1200 | A | 10 | — | — | Substantially none | Excellent | Good | Good | Good | Good | Good |
| 4 | " | " | B | 20 | — | — | Substantially none | Excellent | " | " | " | " | " |
| 5 | 300 | 600 | A | 10 | — | — | Substantially none | Excellent | " | " | " | " | " |
| 6 | 300 | 600 | B | 20 | — | — | Substantially none | Excellent | " | " | " | " | " |
| 7 | 50 | 500 | C | 14*2 | — | — | None | Excellent | " | " | " | " | " |
| Comparative Example 1 | 5 | 500 | A | 10 | — | — | Corroded*3 | Extremely poor | Slightly poor | Poor | Poor | " | " |
| 2 | 300 | 40 | A | 10 | — | — | Corroded*4 | Extremely poor | Slightly poor | Slightly poor | Poor | " | " |
| 3 | 300 | 600 | B | 60 | — | — | None | Excellent | Good | Good | Good | Poor | Poor |
| 4 | 300 | 600 | A | 2 | — | — | Corroded*5 | Poor | Slightly poor | Slightly poor | Poor | Good | Good |
| 5 | | Tin plate No. 50 | | | 10 | 180 | — | — | — | — | — | — | — |
| 6 | | Tin plate No. 25 | | | — | — | Corroded*6 | Good | Slightly poor | Slightly poor | Slightly poor | Good | Good |
| 7 | | TFS-CT | | | — | — | Corroded*7 | Poor | Good | Good | Good | Poor | Poor |

*1in terms of metallic chromium
*2Metallic chromium layer - 5 mg/m$^2$
Crystalline chromiun oxide layer - 3 mg/m$^2$ in terms of metallic Cr
Amorphous hydrated chromium oxide layer - 6 mg/m$^2$ in terms of metallic Cr
*3Numerous instances of corrosion in the form of points were present on the entire flat portions of the specimen.
*4Remarkable corrosion in the form of holes was present on the scratched portions.
*5Corrosion in the form of points was present on the flat portions of the specimen.
*6The width of the scratches become large due to corrosion.
*7Remarkable corrosion in the form of holes was present on the scratched portions.

under a paint layer and the enamel-adhering properties of the coated steel strips in Comparative Examples 1 and 2 were unsatisfactory.

In Comparative Examples 3 and 4, the coated steel strips had chromium-treated surface layers having a weight falling outside the scope of the present invention. The coated steel strip in Comparative Example 3 exhibited a satisfactory corrosion resistance under a paint layer, a satisfactory enamel-adhering property, and a poor seam weldability. The coated steel strip in Comparative Example 4 exhibited a satisfactory seam weldability, a poor corrosion resistance under a paint layer (UCC test), and a poor enamel-adhering property.

We claim:

1. A differential multilayer-coated steel strip useful for the manufacture of cans in which the surface coatings are different from each other, said steel strip consisting of:

(A) a steel strip substrate;

(B) a 3-layered first surface coating formed on a surface of said steel strip substrate consisting of (a) a plated nickel first base layer formed on said surface of said substrate and consisting of from 10 to 5,000 mg/m$^2$ of plated nickel, (b) a plated tin intermediate layer formed on the surface of said first base layer and consisting of from 50 to 11,000 mg/m$^2$ of plated tin, and (c) a chromium-treated first surface layer formed on the surface of said intermediate layer and having a weight of from 3 to 50 mg/m$^2$, in terms of metallic chromium; and (C) a 2-layered surface coating formed on the other surface of said steel strip substrate consisting of (d) a plated nickel second base layer formed on said other surface of said substrate and consisting of from 10 to 5,000 mg/m$^2$ of plated nickel, and (e) a chromium-treated second surface layer formed on the surface of said second base layer and having a weight of from 3 to 50 mg/m$^2$, in terms of metallic chromium.

2. The differential multilayer-coated steel strip as claimed in claim 1, wherein the weight of the nickel base layer in the second coating is in the range of from 100 to 5,000 mg/m$^2$.

3. The differential multilayer-coated steel strip as claimed in claim 1, wherein the weight of the nickel base layer in the second coating is in the range of from 10 to 1,000 mg/m$^2$.

4. The differential multilayer-coated steel strip as claimed in claim 1, wherein the weight of the tin intermediate layer is in the range of from 500 to 11,000 mg/m$^2$.

5. The differential multilayer-coated steel strip as as claimed in claim 1, wherein the weight of each chromium-treated surface layer is in the range of from 5 to 20 mg/m$^2$.

6. The differential multilayer-coated steel strip as claimed in claim 1, wherein each chromium-treated surface layer consists of a metallic chromium layer, a crystalline chromium oxide layer and an amorphous hydrated chromium oxide layer formed in the above-mentioned sequence on the surface of the tin intermediate layer in the first coating or the nickel base layer in the second coating.

7. The differential multilayer-coated steel strip as claimed in claim 6, wherein the weight of the metallic chromium layer is in the range of from 0.1 to 20 mg/m$^2$.

8. The differential multilayer-coated steel strip as claimed in claim 6, wherein the sum of the weight of the crystalline chromium oxide layer and the amorphous hydrated chromium oxide layer is in the range of from 1 to 10 mg/m$^2$ in terms of metallic chromium.

* * * * *